United States Patent [19]

Rosson

[11] Patent Number: 4,804,177

[45] Date of Patent: Feb. 14, 1989

[54] AQUATIC EXERCISE DEVICE

[76] Inventor: Betty Jo Rosson, Rte. 5, Lake Canton, Canton, Ill. 61520

[21] Appl. No.: 190,813

[22] Filed: May 6, 1988

[51] Int. Cl.[4] ..... A63B 31/00; B63C 9/08

[52] U.S. Cl. ..... 272/71; 441/88

[58] Field of Search ..... 272/71.1 R, 1 B, 93; 434/254; 441/56, 57, 58, 23, 81, 88

[56] References Cited

U.S. PATENT DOCUMENTS 1,677,083 7/1928 Heminger ..... 441/88

1,715,571 6/1929 Robertson ..... 441/58

FOREIGN PATENT DOCUMENTS 4190 4/1914 United Kingdom ..... 441/88

*Primary Examiner*—Richard J. Apley

*Assistant Examiner*—S. R. Crow

*Attorney, Agent, or Firm*—Ralph E. Walters

[57] ABSTRACT

The present invention relates to an aquatic exercise device and more specifically to such a device which provides substantially unlimited versatility in performing an infinite number of aquatic exercises in substantially any body position that might be desired. Prior art devices such as life vests, jackets and the like are only adapted to support a user in a substantially upright position with others not being universally adaptable to all sizes of users. The present invention overcomes these problems by providing a pair of interconnected flotation members which afford superior support for the user without restricting any desired movement of selected portions of the body.

2 Claims, 1 Drawing Sheet

AQUATIC EXERCISE DEVICE

DESCRIPTION

TECHNICAL FIELD

The present invention generally relates to an aquatic exercise device and more particularly to such a device for buoyantly supporting the body of a user in the water in a wide variety of exercise positions.

BACKGROUND ART

The benefits of aquatic exercise have long been known wherein the natural buoyancy of the body is utilized to relieve and support most of the weight from the skeleton or frame which permits selected muscle groups to be exercised without placing undue stress or strain on these or other adjacent body parts. In this way, the spine and joints are not subjected to the jarring contact experienced against hard running surfaces encountered by land joggers and the like. The cardiovascular benefits are also quite evident during aquatic exercise training in that the heart rate is about 13 beats less per minute in the water than on land. This is due to the fact that the water keeps the body cool so that the heart does not have to work as hard to pump blood to the surface of the skin for cooling as it does during land exercise. The above advantages are not only beneficial to relatively healthy people primarily interested in maintaining muscle tone and overall vigor but is especially helpful to handicapped people and others having serious medical problems. In the past, the only buoyant exercise device available for such people providing any sense of stability while leaving the hands, arms and legs somewhat free has been the conventional torso-fitted life jacket. Such life jackets or more recently the very expensive exercise vests are quite bulky and cumbersome to wear which restricts the user to a single substantially upright position in the water and prevents the user from assuming a more horizontal position on the stomach or back or a wide variety of other exercise positions which might be desirable to a full-rounded water exercise program. Other commercially available aquatic exercise devices have included inflatable water wings and the like which are difficult to slip on and off the arms and which must be appropriately sized for the particular user with a great variance in sizes required between children and adults. These also do not provide any support beneath the body and do not thereby instill any feeling of confidence particularly with the handicapped or others who may not feel particularly at home in the water. The prior art has also included separate hollow float members which must be individually tightly gripped in the hands and held throughout the exercise which unduly restricts the use of such devices to only a relatively few exercises and are too clumsy to permit any useful exercise of the arms. Therefore, it is recognized that it would be highly desirable to provide an aquatic exercise device which dependably supports the user in the water with virtually no restriction to freedom of movement of all parts of the body during an infinite number of exercises.

DISCLOSURE OF THE INVENTION

In accordance with one aspect of the present invention, there is provided an aquatic exercise device having a pair of buoyant flotation members which are interconnected by an elongated flexible body engaging and supporting tether member with the flotation members adapted to be individually held by the hands of a user and with the tether member being adapted to be disposed in supporting relation to selected portions of the users body in an infinite number of exercise positions.

BEST MODE FOR CARRYING OUT THE INVENTION

Figure 1:
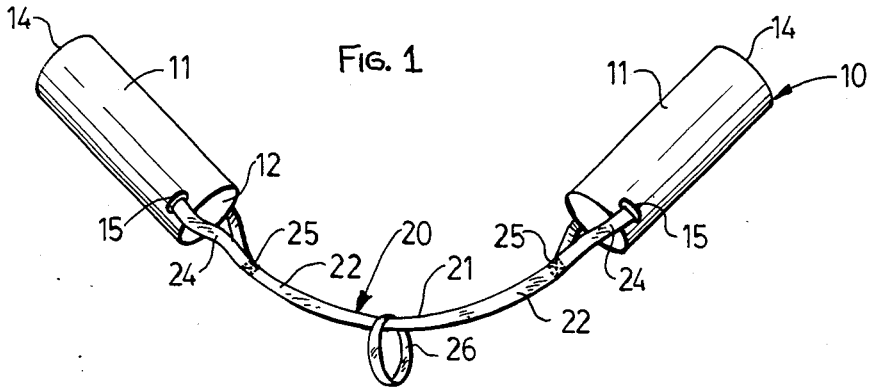
FIG. 1 is a three dimensional view of the aquatic exercise device of the present invention shown in its more basic form.

Referring more particularly to the drawing, an aquatic exercise device embodying the principles of the present invention is generally indicated by the reference numeral 10. The device provides a pair of elongated cylindrical float members 11 which are constructed of a buoyant cellular plastic styrofoam material having a water impervious outer skin providing a buoyancy sufficient to support several hundred pounds of body weight. Each of the float members has an interconnecting end 12 and an opposite outer distal end 14. The connecting end has a slot 15 extended diametrically through the float member for a purpose soon hereinafter to be described.

An elongated tether or connecting strap 20 of flexibly webbed fabric material is extended in interconnecting relation between the float members 11. The tether strap includes a body engaging mid-portion 21 and opposite ends 22. Each end has a looped handle portion 24 which is extended through the slot 15 in each of the associated float members 11 and stitched to the strap as at 25 or rigidly connected thereto by any other suitable fastening device. A circular belt receiving loop 26 is mounted in circumscribing relation to the mid-portion 21 of the tether strap and is freely slideably disposed thereon for movement between the looped handles 24 thereof. Alternatively, the handled loops 24 at the ends of the tether strap 20 can be augmented by enlarging the slots 15 in the inner ends 12 of the float members to form an integral handle from the styrofoam material of the float members themselves, not shown.

Figure 2:
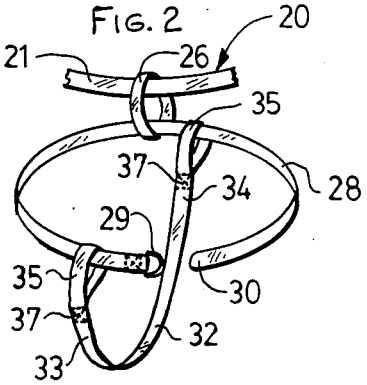
FIG. 2 is a somewhat enlarged three dimensional view of the body connecting portion of the device of FIG. 1 including auxiliary body support members included for maximum support of the user.

The basic aquatic exercise device unit as described above can be easily supplemented by the auxiliary belt system shown in FIG. 2 for those users requiring an extra degree f reassurance and stability when disposed in the water. In such augmented system an elongated webbed flexible belt 28 is extendable through the belt receiving loop 26 on the mid portion 21 of a tether strap 20 and includes a buckled end 29 through which is extendable in gripping relation a free end 30 for tightening about the waist of a user. A crotch strap 32 can be added for additional stability which has opposite front and rear ends 33 and 34, respectively. Each end of the crotch strap has a looped portion 35 which is extended back for connection to the strap by a stitched portion indicated by the reference numeral 37. A user shown in phantom lines at 40 in FIGS. 3 and 4 is shown in a body of water 42 in which the user is supported by the buoyant aquatic exercise device of the present invention.

INDUSTRIAL APPLICABILITY

Figure 3:
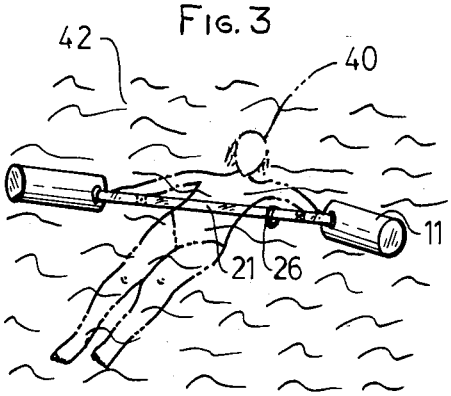
FIG. 3 is a three dimensional view of the aquatic exercise device showing a representative use of the basic form of FIG. 1.
Figure 4:
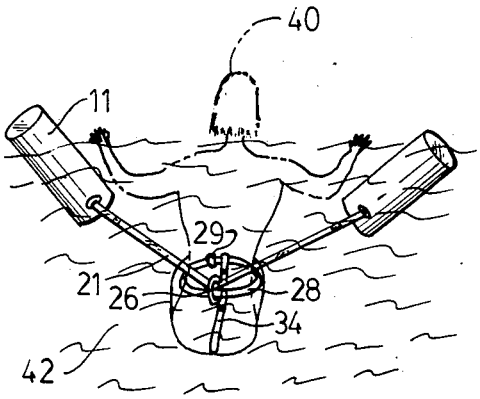
FIG. 4 is a three dimensional view showing the aquatic exercise device during a representative use of the complete form of FIG. 2.

The basic aquatic exercise device 10 of the present invention, as depicted in FIG. 1, may be utilized in a variety of aquatic exercises with one such representative exercise shown in FIG. 3 in which the handle portions 24 of the tether strap 20 are gripped in the hands of the user 40 with the arms of the user being extended outwardly from the body to position the mid portion 21 in supporting relation against the back of the user. In such position the user can comfortably lay back against the tether strap with the assurance that the head will be held above the surface of the water which will permit unrestricted movement of the lower torso and leg portions of the user through the water. Although not shown in the drawing, the tether strap can also support the user in a sitting position by extending the strap beneath the buttocks of the torso to hold the upper portion of the body in a more upright position. The tether strap may also be straddled by the user in which position the float members 11 will extend upwardly in front of and immediately behind the user in a position to be firmly grasped and held onto as if riding a hobbyhorse or the like.

The supplemental support members including the waist engaging belt 28 and the crotch belt 32 can be assembled on the mid portion 21 of the tether strap 20 by use of the free loop 26 when greater stability in the water is desired. One representative position of the user is shown in FIG. 4 with the aquatic exercise device of FIG. 2 shown assembled about the user 40 in order to support he or she in a substantially sitting position in which position the float members 11 can be disposed either forwardly or rearwardly of the users shoulder and upper arm area. Such use of the belt and crotch strap affords a greater degree of assurance and confidence to those persons who might be poor swimmers or have some other physical defect that might require the additional support afforded thereby. In all positions the handle portions 24 of the tether strap can be selectively grasped by the user if a particular exercise would require additional resistance to arm movement or the arms can be completely freed leaving the float members in a free floating position so that the arms can be used without such additional restriction.

In view of the foregoing it is readily apparent that the device of the present invention provides a greatly improved exercise aid for aquatic use which provides a virtually unlimited variety of user positions within the water which provides dependable support during an infinite variety of exercise positions. It is significant that such device provides only that amount of support which is desired to be necessary for any particular exercise ranging from very minimal support to almost total flotation of the user in any depth of water.

I claim:

1. An aquatic exercise device comprising;

a pair of buoyant elongated cylindrical flotation members individually providing an interconnecting end having a transverse slot therethrough, and an opposite outer distal end;

a flexible body engaging and supporting tether strap having a mid-portion and opposite looped handle ends individually extended through said slots in their respectively associated interconnecting ends of the flotation members;

a continuous ring strap mounted on said mid-portion of the tether strap;

and a belt extendable through said ring strap for releasably fastening about the waist of a user to provide a releasable buoyant support to a user during aquatic exercise activity.

2. The aquatic exercise device of claim 1 including a crotch strap having opposite looped front and rear ends respectively receiving said belt therethrough for extension between the legs of a user.

* * * * *